US005295272A

United States Patent [19]

Juushi

[11] Patent Number: 5,295,272

[45] Date of Patent: Mar. 22, 1994

[54] LAID-ON PAPER CUT-OFF SYSTEM FOR TOILET SEAT

[75] Inventor: Hiroyuki Juushi, Nagatoro, Japan

[73] Assignee: Nihon-Isued Co., Ltd., Saitama, Japan

[21] Appl. No.: 903,321

[22] Filed: Jun. 24, 1992

[30] Foreign Application Priority Data

Dec. 17, 1991 [JP] Japan ..... 3-104011[U]

[51] Int. Cl.[5] ..... A47K 13/20

[52] U.S. Cl. ..... 4/243.3

[58] Field of Search ..... 4/243.1, 243.3, 244.2, 4/244.1, 250

[56] References Cited

U.S. PATENT DOCUMENTS

| | | | |
|---|---|---|---|
| 1,449,439 | 3/1923 | Phillips | 4/250 |
| 2,051,692 | 8/1936 | Elrick | 4/243.3 |
| 4,106,135 | 8/1978 | Mannheim | 4/244.1 |
| 4,926,505 | 5/1990 | Higuchi et al. | 4/243.3 |
| 5,203,036 | 4/1993 | Juushi | 4/243.3 |

*Primary Examiner*—Charles E. Phillips

*Attorney, Agent, or Firm*—Wenderoth, Lind & Ponack

[57] ABSTRACT

Laid-on paper delivered from a laid-on paper roll and laid on a toilet seat can be easily separated after use, not requiring hands. A toilet is provided with a delivery roller part for clamping the laid-on paper from a laid-on paper roll, the laid-on paper having perforated lines to cut off the laid-on paper for each amount of use, and the delivery roller part pulling out the laid-on paper by the rotation thereof and delivering the laid-on paper onto the toilet seat. A rear portion of the toilet seat is vertically movably provided and upwardly urgingly supported by springs in a rear part of the toilet. A brake mechanism for stopping the rotation of the delivery roller part due to the lowering motion of the toilet seat is also provided.

12 Claims, 5 Drawing Sheets

LAID-ON PAPER CUT-OFF SYSTEM FOR TOILET SEAT

BACKGROUND OF THE INVENTION

1. Field of the Invention

This invention relates to a laid-on paper cut-off system for a toilet seat. For cutting off laid-on paper delivered onto the toilet seat. In a toilet or closet provided with a delivery roller part for pulling out the laid-on paper from a laid-on paper roll, the laid-on paper having perforated lines for cutting off the laid-on paper for each amount of use, and delivering the laid-on paper onto the toilet seat.

2. Description of the Prior Art

It has been a common practice that, in order to prevent unsanitary use by directly contacting the skin with the toilet seat and to alleviate coldness when sitting on the toilet seat, laid-on paper for the toilet seat is laid on the toilet seat for use. Heretofore, the laid-on paper has been stored, being superposed on one another in a storing box placed at a position close to a closet, and, when necessary, the laid-on paper has been taken out of the storing box one after one for use. However, recently a method has been practiced where the laid-on paper is rolled into a roll shape, pulled out of the roll and delivered onto the toilet seat. This laid-on paper has perforated lines for each amount of use, and the laid-on paper which has been used is cut off along the perforated line and disposed after the use.

However, there is a very troublesome problem in that cut-off of the laid-on paper after the use is performed one by one manually

SUMMARY OF THE INVENTION

The present invention has been developed to obviate the above-described problem and has as its object the provision of a laid-on paper cut-off system for a toilet seat wherein cut-off of the laid-on paper is easily performed without requiring the hands of a user.

To achieve the above-described object, according to the present invention, in a closet provided with a delivery roller part for clamping the laid-on paper from a laid-on paper roll, the laid-on paper having perforated lines to cut off the laid-on paper for each amount of use i.e. an individual toilet seat cover, pulling out the laid-on paper by the rotation thereof and delivering the laid-on paper onto the toilet seat, such an arrangement is adopted that a rear portion of the toilet seat is vertically movably provided and upwardly urgingly supported by springs in a rear part of the closet, and a brake mechanism for stopping the rotation of the delivery roller part due to a lowering motion of the toilet seat is provided.

When the delivery roller part is rotated to deliver the laid-on paper from the laid-on paper roll onto the toilet seat and the body of the user is lowered onto the toilet seat, the rear portion of the toilet seat, which has been raised through the resiliency of the springs, is lowered by the body weight against the resiliency of the springs. When the rear portion of the toilet seat is lowered, the brake mechanism functions to stop the rotation of the delivery roller part, clamping the laid-on paper, whereby the laid-on paper is clamped and cannot be pulled out. In this state, if the rear portion of the toilet seat is further lowered, then the laid-on paper on the toilet seat is fixed, being clamped by the toilet seat and the body, whereby the laid-on paper is extended between the delivery roller part and the toilet seat as the rear portion of the toilet seat is lowered, so that the laid-on paper is separated along the perforated line by the extension.

DETAILED DESCRIPTION OF THE PREFERRED EMBODIMENTS

The present invention will hereunder be described in detail in conjunction with the embodiments shown in the accompanying drawings.

Figure 1:
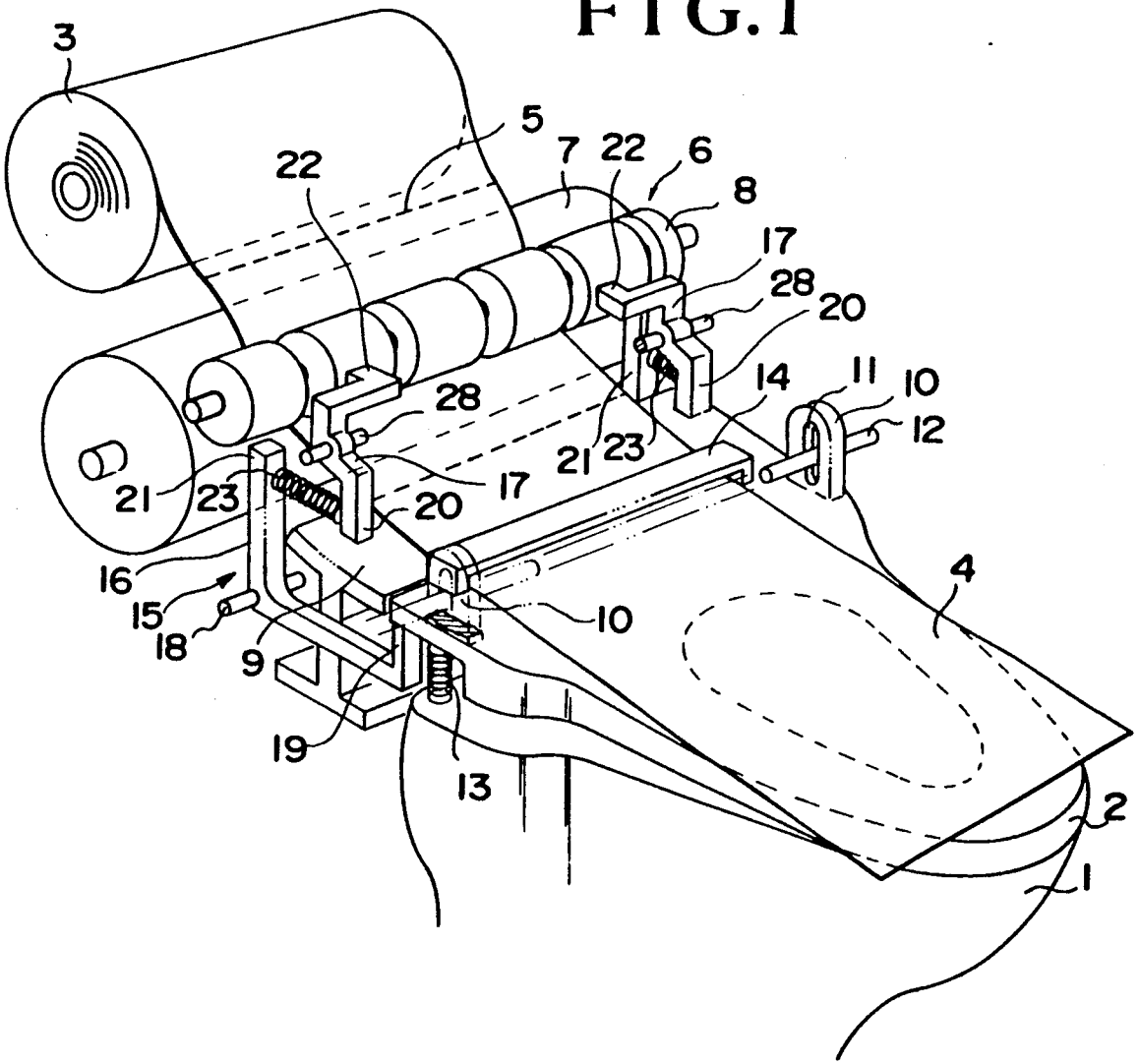
FIG. 1 is a perspective view showing one embodiment of the present invention.
Figure 2:
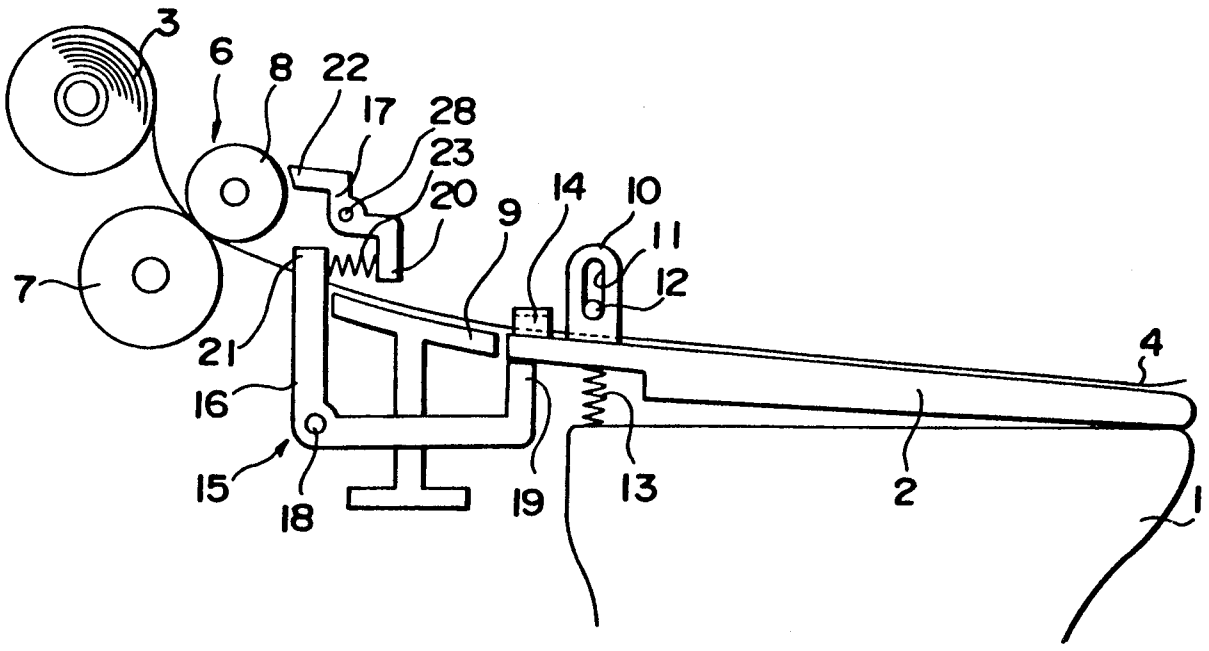
FIG. 2 is a side view showing the embodiment illustrated in FIG. 1.
Figure 3:
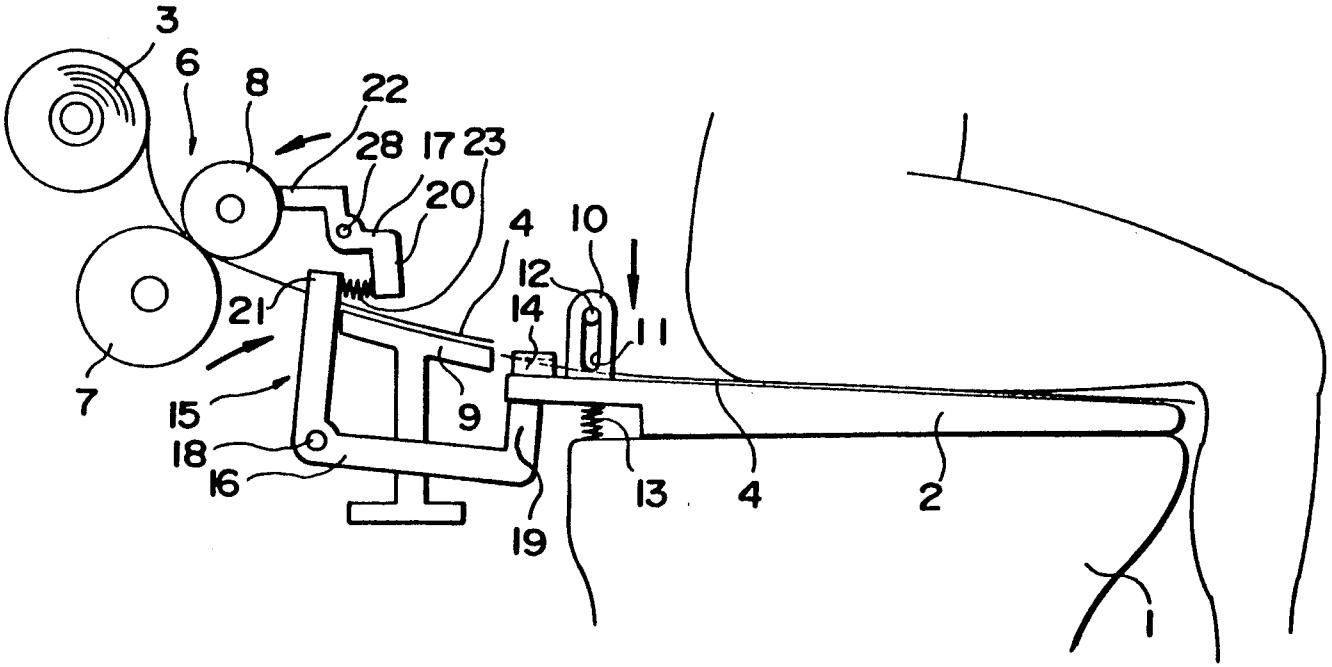
FIG. 3 is an explanatory view showing the operation of cutting off laid-on paper.

FIGS. 1 to 3 show one embodiment of the present invention. Referring to the drawings, designated at 1 is a closet and 2 a toilet seat provided on the closet 1. Denoted at 3 is a laid-on paper roll and 4 laid-on paper. This laid-on paper 4 is formed with perforated lines 5 for each amount of use. The laid-on paper roll 3 is supported by a suitable support means in the rear of the closet 1.

Designated at 6 is a delivery roller part for clamping the laid-on paper 4, pulling out the laid-on paper 4 by rotation and delivering the laid-on paper 4 onto the toilet seat 2. This delivery roller part is constituted by a pair of rollers including a driving roller 7 and a pressing roller 8 which are in pressing contact with each other. The driving roller 7 and the pressing roller 8 clamp the laid-on paper 4 therebetween and are rotated, whereby the laid-on paper 4 is pulled out of the laid-on paper roll 3 and delivered onto the toilet seat 2. Denoted at 9 is a guide plate 9 provided at a position close to a rear end of the toilet seat 2, for guiding the laid-on paper delivered from the delivery roller part 6 onto the toilet seat 2.

A rear portion of the toilet seat 2 is vertically movably and rotatably supported on the top surface of the rear portion of the closet 1, as will be described hereunder. Designated at 10 are support pieces provided at opposite sides of the rear portion of the toilet seat 2. Each of these support pieces 10 is formed with a slot 11 in a vertical direction. A support shaft 12 is inserted through these slots 11. The rear portion of the toilet seat 2 is thus vertically movably and rotatably supported on the rear portion of the closet 1. Denoted at 13 are springs for urging the rear portion of the toilet seat 2 upwardly. Thus, the rear portion of the toilet seat 2 is constantly urged upwardly through the resiliency of the springs 13.

Denoted at 14 is a guide frame provided on the top surface of the rear portion of the toilet seat 2. The laid-on paper 4 guided by the guide plate 9 passes through the guide frame 14 and is delivered onto the toilet seat 2.

Denoted at 15 is a brake mechanism for receiving the lowering operation of the rear portion of the toilet seat 2 and functioning to stop the rotation of the delivery roller part 6.

This brake mechanism 15 is constituted by working levers 16 and stop levers 17 operated by the working of the working levers 16. The substantially L-shaped working levers 16 are positioned at opposite sides of the rear portion of the toilet seat 2 and the intermediate portions thereof are rotatably supported by a shaft 18. End portions 19 on one side of the working levers 16 are abutted against the undersurface of the rear portion of the toilet seat 2, whereby the lowered rear portion of the toilet seat pushes the end portions 19 so that the working levers 16 are rotated about the shaft 18. Furthermore, end portions 20 on one side of the stop levers 17 are opposed to end portions 21 on the other side of the working levers 16. End portions 22 on the other side of the stop levers 17 are opposed to the pressing roller 8 of the delivery roller part 6 and intermediate portions of the stop levers 17 are rotatably supported on shafts 28. Then, springs 23 are interposed between the end portions 21 on the other side of the working levers 16 and the end portions 20 on one side of the stop levers 17, and the stop levers 17 are rotated through the resiliency of the springs 23 when the working levers 16 are rotated, whereby the end portions 22 on the other side of the stop levers 17 are abutted against the pressing roller 8 through the resiliency of the springs 23 to thereby stop the rotation of the pressing roller 8.

With the above-described arrangement, when the delivery roller part 6 is rotated to deliver the laid-on paper from the laid-on paper roll 3 onto the toilet seat 2 (FIG. 1 and FIG. 2), and the body of the user is lowered onto the toilet seat 2, the rear portion of the toilet seat 2, which has been raised through the resiliency of the springs 13, is lowered by the body weight against the resiliency of the springs 13. When the rear portion of the toilet seat 2 is lowered, the end portions 19 on one side of the working levers 16, which have been abutted against the undersurface of the rear portion of the toilet seat 2, are moved to rotate the working levers 16. When the working levers 16 are rotated, the end portions 21 on the other side of the working levers 16 push the end portions 20 on one side of the stop levers 17 through the resiliency of the springs 23, whereby the stop levers 17 are rotated and the end portions 22 on the other side of the stop levers 17 are abutted against the pressing roller 8 of the delivery roller part 6 through the resiliency of the springs 23 to thereby stop the rotation of the pressing roller 8. As a result, the laid-on paper 4 is clamped by the pressing roller 8 and the driving roller 7, which constitute the delivery roller part 6, and is fixed so that the laid-on paper 4 cannot be pulled out of the delivery roller part 6.

In this state, when the rear portion of the toilet seat 2 is further lowered, because the laid-on paper 4 on the toilet seat 2 is clamped by the toilet seat 2 and the body, and fixed thereat, as the rear portion of the toilet seat 2 is lowered, the laid-on paper 4 is extended between the delivery roller part 6 and the toilet seat 2, so that the laid-on paper 4 is separated along the perforated line 5 by the extension (FIG. 3).

Figure 4:
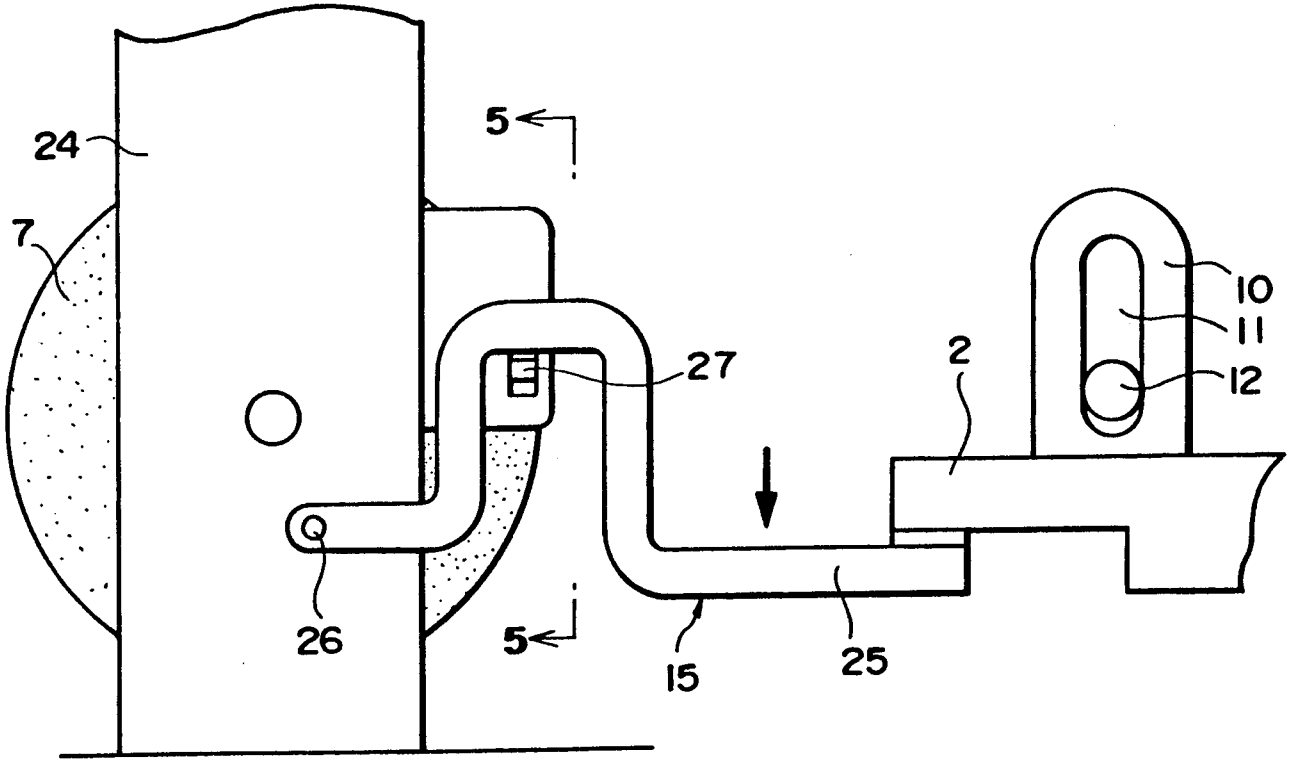
FIG. 4 is a partial side view showing another embodiment of a brake mechanism.
Figure 6:
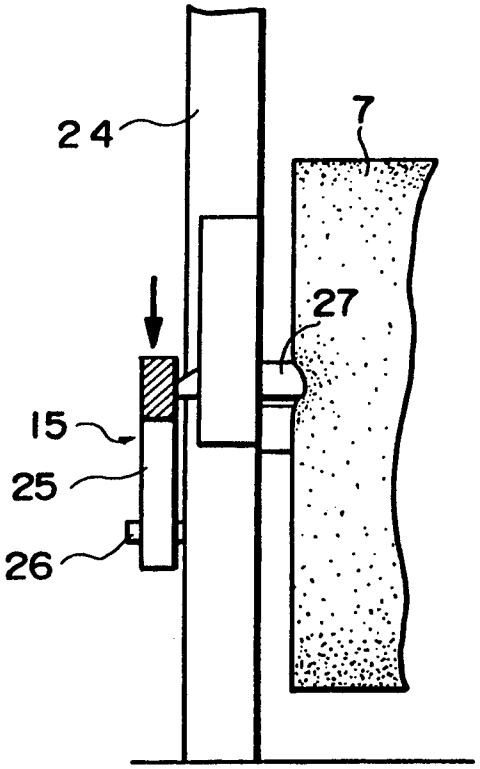
FIG. 6 is an explanatory view showing a state of a braking operation in FIG. 4.
Figure 5:
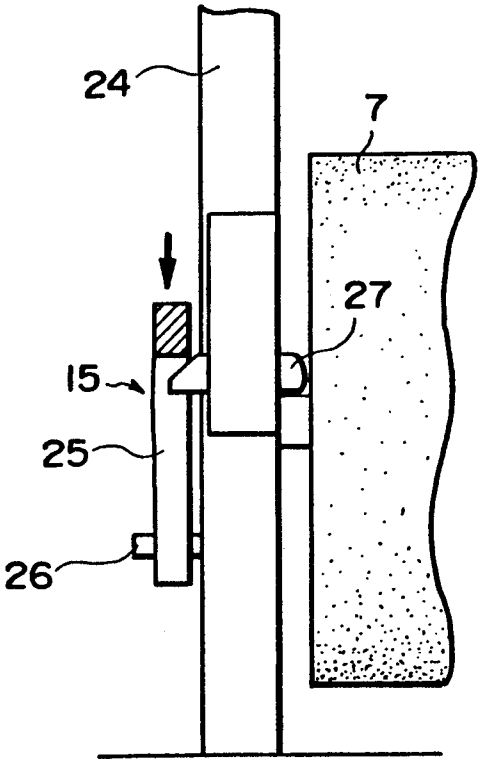
FIG. 5 is a view taken in the direction indicated by the arrows from the line 5—5 in FIG. 4.

FIGS. 4 to 6 show another embodiment of the brake mechanism 15, constructed as will be described hereunder.

End portions on one side of working levers 25 are rotatably supported through a shaft 26 on support pieces 24 for supporting the delivery roller part 6. End portions on the other side of the working levers 25 are engaged with the rear portion of the toilet seat 2 and are rotatable about the shaft 26 by the vertical motion of the toilet seat 2. Furthermore, stop pins 27 linearly movable to or from the driving roller 7 of the delivery roller part 6 are provided on the support pieces 24. The stop pins 27 are pushed by the working levers 25 through the rotation of the working levers 25 due to the lowering of the toilet seat 2, whereby the stop pins 27 are abutted against the driving roller 7 to stop the rotation of the driving roller 7, and released from the pushing of the working levers 25 by the rotation of the working levers 25 due to the rise of the toilet seat 2 so that the stop pins 27 are separated from the driving roller 7.

As has been described hereinabove, only lowering of the body onto the toilet seat makes it possible to separate the laid-on paper laid on the toilet seat along the perforated line, so that such advantages can be achieved that the user can be very conveniently freed from any trouble in separating the laid-on paper manually after use, and further, the system being simplified in construction, can be manufactured with ease.

What is claimed is:

1. An apparatus for a toilet, comprising:

a toilet seat having a front end and a rear end, said seat being positioned on a generally horizontal surface of a toilet;

a paper roll having a roll of paper thereon which paper is to be dispensed onto said toilet seat, the roll of paper having perforated lines extending transverse to said roll such that individual toilet seat covers can be removed from the paper roll;

a delivery roller mechanism clamping the paper from said paper roll and arranged so as to deliver and individual cover onto said toilet seat upon rotation of said roller mechanism;

wherein said rear end of said seat is vertically movably mounted between a raised and a lowered position and supported on said toilet by springs upwardly biasing said rear end above said horizontal surface with said front end resting on said horizontal surface;

a brake mechanism mounted adjacent said rear end of said seat and being engageable with said delivery roller mechanism; said brake mechanism being operably connected to said toilet seat such that a lowering motion of the rear end of said toilet seat from said raised position to said lowered position causes said brake mechanism to engage with said delivery roller mechanism and stop said rotation thereof, such that when a user sits on said cover overlying said seat, downward movement of said seat and cover with said cover clamped between the user and said seat at one location and said paper roll being engaged by said braking mechanism said cover will be separated from said roll.

2. The apparatus of claim 1, wherein said delivery roller mechanism comprises a drive roller and a pressing roller clamping the paper therebetween.

3. The apparatus of claim 2 and further comprising a guide plate between said delivery roller mechanism and said toilet seat and a guide frame on the rear of said toilet seat for guiding the paper from said delivery roller mechanism to said toilet seat.

4. The apparatus of claim 1 and further comprising a guide plate between said delivery roller mechanism and said toilet seat and a guide frame on the rear of said toilet seat for guiding the paper from said delivery roller mechanism to said toilet seat.

5. The apparatus of claim 1, wherein said toilet seat is vertically movably mounted by a pair of support pieces on the rear of said toilet seat, each said support piece having a vertical slot and a support shaft extending into said slot.

6. The apparatus of claim 1, wherein said brake mechanism includes a lever having one end engaged with the rear end of said toilet seat and a stop member movably mounted for movement by said lever so as to engage said delivery roller mechanism when the rear end of said toilet seat is lowered.

7. The apparatus of claim 6, wherein said stop member is a pivotally mounted stop lever resiliently connected to the other end of said lever for pivotally engaging said delivery roller mechanism.

8. The apparatus of claim 7, wherein said delivery roller mechanism comprises a drive roller and a pressing roller clamping the paper therebetween, and said stop lever engages said pressing roller.

9. The apparatus of claim 7, wherein said stop lever has one end connected to said other end of said lever by a spring and another end for engaging said delivery roller mechanism.

10. The apparatus of claim 6, wherein said stop member is a stop pin that is linearly movably mounted for engagement with said delivery roller mechanism, said stop pin being engaged and pushed by said lever.

11. The apparatus of claim 10, wherein said delivery roller mechanism comprises a drive roller and a pressing roller clamping the paper therebetween, and said stop pin engages said drive roller.

12. The apparatus of claim 10, wherein said lever is pivotably mounted at the other end thereof and engages said stop pin between said ends of said lever.

* * * * *